US007044031B1

(12) United States Patent
Mullen

(10) Patent No.: US 7,044,031 B1
(45) Date of Patent: May 16, 2006

(54) FASTENER DRIVING TOOL

(76) Inventor: Steven Mullen, 335 N. Worthington, West Memphis, AR (US) 72301

( * ) Notice: Subject to any disclaimer, the term of this patent is extended or adjusted under 35 U.S.C. 154(b) by 0 days.

(21) Appl. No.: 11/135,976

(22) Filed: May 24, 2005

(51) Int. Cl.
*B25B 13/06* (2006.01)

(52) U.S. Cl. ..... 81/121.1; 81/52; 81/120; 81/124.2; 81/124.3; 81/124.6; 81/124.7; 81/125

(58) Field of Classification Search ..... 81/52, 81/120, 121.1, 125, 124.2, 124.3, 124.6, 81/124.7
See application file for complete search history.

(56) References Cited

U.S. PATENT DOCUMENTS

| | | | | |
|---|---|---|---|---|
| 2,718,806 | A | 9/1955 | Clark | |
| 3,007,504 | A | 11/1961 | Clark | |
| 3,707,894 | A | 1/1973 | Stillwagon, Jr. | |
| 5,327,801 | A | 7/1994 | Andreasen et al. | |
| 5,797,711 | A | 8/1998 | Mulgrave et al. | |
| 5,918,512 | A * | 7/1999 | Habermehl et al. | 81/438 |
| 6,138,538 | A | 10/2000 | Neijndorff | |
| 6,269,716 | B1 | 8/2001 | Amis | |
| 6,290,499 | B1 * | 9/2001 | Lazzara et al. | 433/173 |
| 6,626,627 | B1 * | 9/2003 | Oesterle et al. | 411/410 |
| 6,715,384 | B1 | 4/2004 | Kozak | |

* cited by examiner

*Primary Examiner*—Lee D. Wilson
*Assistant Examiner*—Shantese McDonald
(74) *Attorney, Agent, or Firm*—Wyatt, Tarrant & Combs, LLP

(57) ABSTRACT

The present invention is directed to an improved tool for driving a threaded fastener, such as a hex-headed sheet metal screw. The driving socket is adapted with an counter-bore in the region of the face of driving end of the socket, sufficient to receive therein the shoulder on the fastener head. In the preferred embodiment the counter-bore is countersunk into the face of the socket, coaxially with the driving recess, and terminates in a boss which receives the shoulder of the fastener when placed in the socket for driving. An alternative embodiment of the invention includes an counter-bore in the driving end of the socket wherein the bore is a conical section, the major diameter of which is larger enough to receive the shoulder of the fastener head while being of limited depth so as to enable the majority of the fastener head to engage the driving sides of the hexagonal socket.

5 Claims, 2 Drawing Sheets

FIG. 3
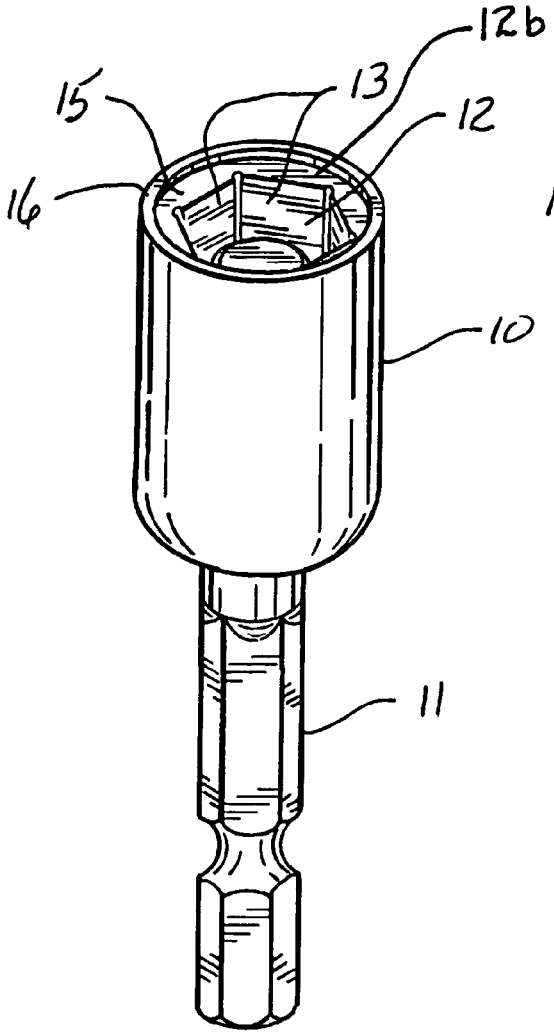
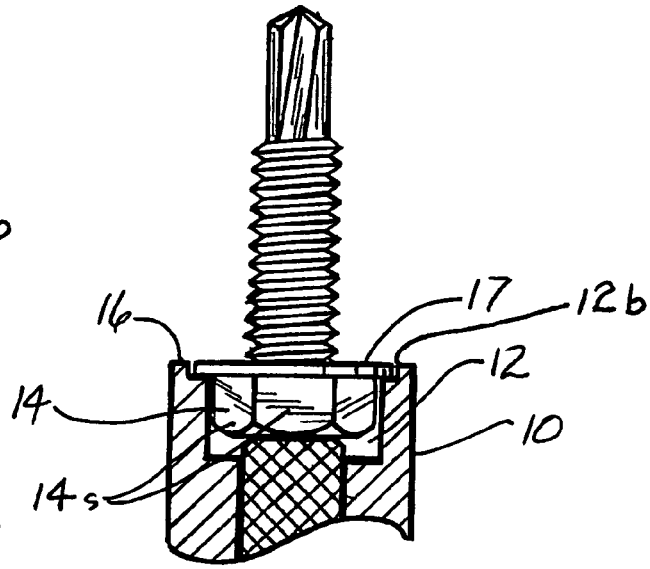
FIG. 4
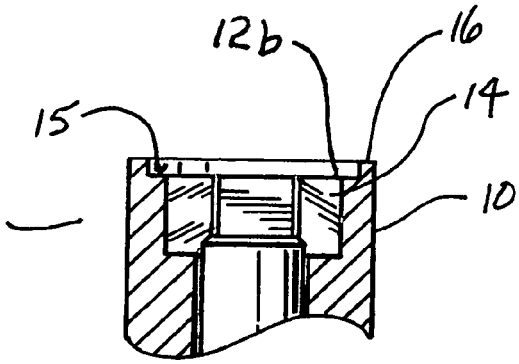
FIG. 5

FASTENER DRIVING TOOL

CROSS-REFERENCE TO RELATED APPLICATIONS

None

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved tool for the driving of fasteners. The tool is in the form of a socket wrench wherein the socket is either permanently attached to a shank, such as a screw or nut driver handle either permanently attached to a handle, such as a screw or nut driver, or in the form of a bit, the shank of which is received into a socket in a driving tool, either air or electrically powered.

2. General Background of the Invention

With the advent of sophisticated power tools and a surge in commercial and home construction, the need for a reliable driver for such as sheet metal screws has emerged. The demand for skilled installers of such as heating and air conditioning duct work has placed a premium on the time and thus the efficiency of the installer. One of the common problems in the installation of heating and air conditioning duct is that it is frequently in hard to reach areas of a building, and often with the installer having to assume awkward and unsteady positions to reach the site where a sheet metal screw is needed to connect duct sections or attach support straps. Even with driver sockets including magnets contained within the socket, screws are often lost, generally in the initial phase of setting the screw. Installation and repair often occurs at levels above other construction activity or at a location where lost fasteners may pose a threat of personal injury, or fall into operating machinery thereby causing damage. Accordingly, retention of the fastener in the socket during driving is of significant importance.

The prior art reveals a number of patents in the related area, but none address the particular problem discussed herein:

U.S. Pat. No. 2,718,806 to Clark illustrates a conventional magnetic driving tool for such as nuts, bolts and other threaded fasteners having multi-sided heads, such as the hex-headed sheet metal screw. Clark discloses the inclusion of a magnet within the socket to assist in holding the fastener in the socket during the driving step.

U.S. Pat. No. 3,007,504 also to Clark illustrates improvements to the '806 patent wherein the tool is adapted to provide interchangeability for all types and characters of bits or sockets.

U.S. Pat. No. 3,707,894 shows an alternative socket for driving a fastener adapted with multiple magnets for retaining both the fastener and also such as a washer to be placed when driving the screw fastener.

U.S. Pat. No. 5,327,801 to Andreasen shows apparatus for attaching a duct strap material to an overhead support by means of a screw-type fastener. The driver is coupled to a pole and driven by such as battery power to enable the installer to work overhead from the floor or other secure base yet reach distant overhead sites.

Likewise, U.S. Pat. No. 5,797,711 to Mulgrave, et al, discloses a method of securing sheet material to a support by means of a screw threaded fastener having a driving head adapted to cooperate with a driving tool in a means similar to the present invention. The driving tool illustrated in the '711 patent is representative of the prior art on which the present invention improves.

U.S. Pat. Nos. 6,138,538; 6,269,716; and 6,715,384 illustrate other adaptations to fastener driving tools, for specific applications and fasteners.

In spite of the numerous styles of fastener drivers illustrated in the prior art, none offer the advantages of retention of the fastener within the socket as well as provided by the present invention.

SUMMARY OF THE INVENTION

The present invention is directed to an improved driving tool for a threaded fastener such as a hex-head screw, bolt or nut wherein the socket is adapted to receive the head and any shoulder on the fastener within the bore of the socket.

The present invention also is directed to an adaptation of the socket with an counter-bore and boss adjacent the open end of the socket whereby the shoulder of the fastener may be seated on the boss, its periphery closely received by the counter-bore with the fastener head being received in the driving socket.

The present invention is also directed to an embodiment of an adaptation of the socket with an counter-bore adjacent the open end of the socket, wherein the bore is in the shape of a truncated cone, of a depth suitable to receive the shoulder of the fastener, and the periphery closely received and bares on the truncated cone and the fastener head being received in the driving socket.

These and other alternative features of the invention will be evident from the detailed description of the invention following.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 3 is a perspective view of a preferred embodiment of the driving tool of the apparatus of the present invention;

FIG. 4 is a sectional view of the preferred embodiment of the tool of the apparatus of the present invention, including the threaded fastener to be driven;

FIG. 5 is another sectional perspective view of the tool of FIG. 4, however without the fastener in place;

DETAILED DESCRIPTION OF THE INVENTION

Figure 1:
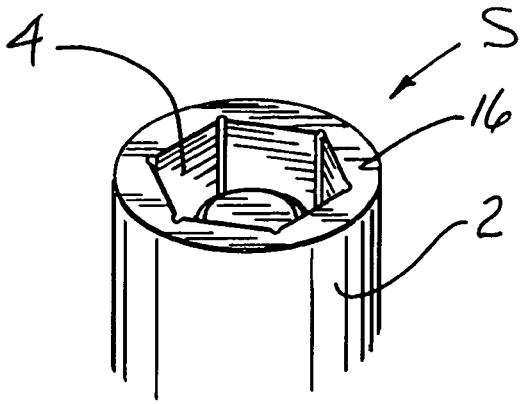
FIG. 1 PRIOR ART
FIG. 1 is a partial perspective view of a prior art driving tool.
Figure 2:
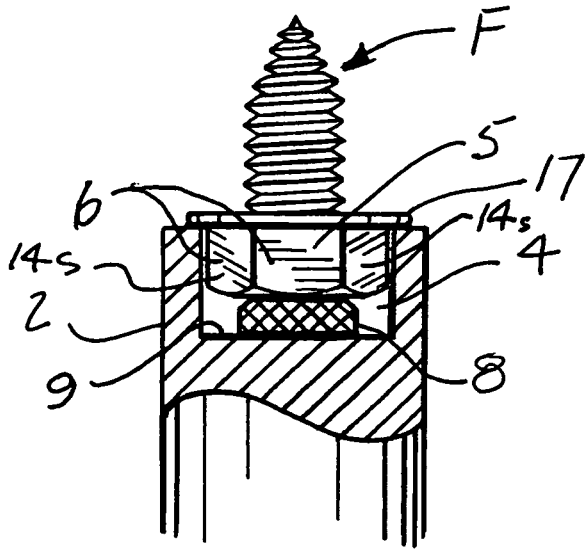
FIG. 2 PRIOR ART
FIG. 2 is a sectional view of the tool illustrated in FIG. 1, including a screw fastener ready for being driven.

FIGS. 1 and 2 show generally the prior art driving tool S which the present invention improves upon. The embodiments described subsequently are those commonly adapted for use with a battery or air powered socket driver. The invention may also be utilized in connection with hand-held, integral driving tools similar to the conventional screw, nut or bolt driver, wherein the driving socket is secured to the shaft of the driver handle.

In FIGS. 1 and 2, tool S includes the socket housing 2 within which includes socket opening 4, which in the illustrated embodiment is adapted with a hexagonal configuration in order to closely receive the head 5 and respective sides 6 of fastener F. As is conventional with industrial type drivers, socket opening 4 is adapted with a permanent magnet 8 which is received in and secured to the base 9 of recess 4.

The preferred embodiment of the present invention is illustrated in FIG. 3, wherein inventive socket 10 is mounted on drive shank 11, which is of a conventional hexagonal cross section to be received in power drivers. Those skilled in the art should recognize that drive shank 11 might also be of other configurations, as square, depending upon whatever is the preferred configuration of the power driver. Socket 10 includes aperture 12, which is illustrated to be hexagonal in cross section, having sides 13. Aperture 12 and the disposition of sides 13 are coordinated to be of a size to closely receive a fastener head 14. Common sizes of fastener heads are ¼ inch and 5/16 inch. FIGS. 3, 4 and 5 illustrate an adaptation to aperture 12, being an counter-bore 12*b* in which a boss 15 is countersunk into the face 16 of socket 10. As will be observed in FIGS. 2, 4 and 7, fastener heads 14 include a shoulder 17 (circular) around the base of the fastener head sides 14*s*, forming the flat 18 terminating the threaded portion 19 of fastener F. Such fasteners are typical of those used for fastening sheet metal parts such as heating and air conditioning duct and metal studs. Shoulder 17 is typically about 0.025 to about 0.035 inches in thickness and extends radially about 0.310 to about 0.340 inches for a ¼ inch headed screw. In the instance of 5/16 inch screws, the shoulder 17 is typically about 0.025 to 0.035 inches in thickness and extends radially from about 0.395 to about 0.405 inches.

In the present embodiment, the counter-bore 12*b* and boss 15 exhibit a depth of about the thickness of shoulder 17 to slightly deeper, however less than twice the thickness of shoulder 17 so as to not compromise the surface contact of sides 13 and 14*s* during the driving operation. Similarly, the diameter of the boss 15 is slightly larger than the diameter of shoulder 17 whereby the shoulder 17 will be closely received within the counter-bore 12*b* and on boss 15. It has been found that the inclusion of the boss configuration in such as socket 10 for driving hexagonally headed fasteners, that the fasteners F are much better retained within the socket S than prior art devices, particularly during the initial driving turns of the driver while fastener F is being set into the receiving metal. It is theorized that during this period that the fastener F is subjected to lateral forces as the thread begins its penetration of the receiving, material which is commonly sheet metal. Those familiar with driving fasteners such as hex-headed screws, into metal or wood have experienced the "wobble" of the screw as the thread or cutting tip makes its initial cut. With the fastener shoulder 17 being closely received within counter-bore 12*b* and seated on the boss 15 of the present invention, it is better secured against tilting on the face 16 of the driving tool, wherein in conventional sockets, it is retained only by the fastener head sides, which on close examination are often not exactly parallel to the axis of the fastener, but rather slightly sloped toward the axis (when viewed the shoulder 17 to the top 19 of the fastener head. Accordingly, with the present invention, the fastener head is retained within the envelope of the counter-bore 12*b* and boss 15 and is thus less prone to angulation on the driving tool and slipping out of the socket during driving.

Figure 6:
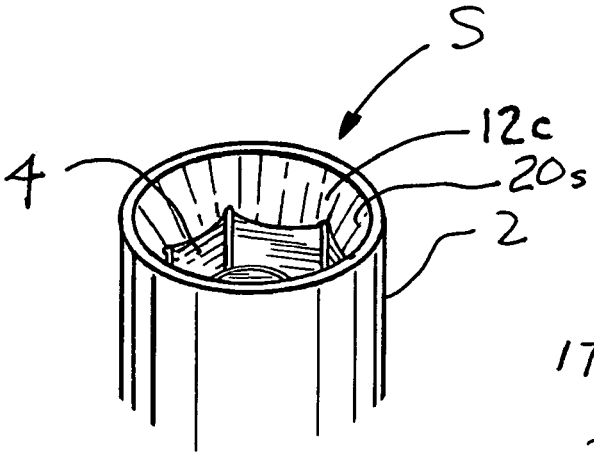
FIG. 6 is a partial perspective view of an alternative embodiment of the tool of the present invention.
Figure 7:
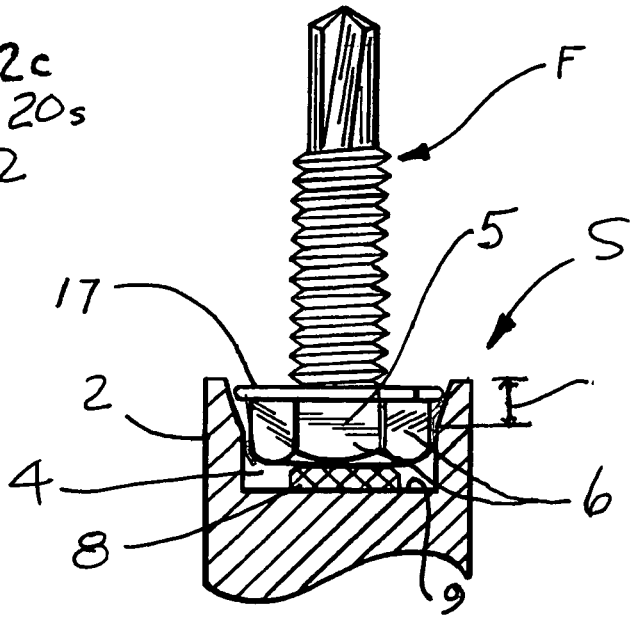
FIG. 7 is a partial sectional view of the tool illustrated in FIG. 6, including the fastener to be driven.

FIGS. 6 and 7 illustrate an alternative embodiment of the present invention. In this embodiment, socket 10 and aperture 12 exhibit a conical section 12*c* which is milled into the face 16 to a depth representing about one to four times the depth of the fastener head shoulder 17 (about 0.025 to about 0.100 inches). The major diameter of the section 20 is about that of the diameter of boss 15, whereby the shoulder 17 is received within the interior of conical section 12*c* to be able to be firmly seated on the conical side 20. As may be seen in FIG. 7, the conical section 12*s* terminates at a position approximately half way up the fastener head side 14*s*, above which the head 14 is retained within the socket firmly in contact with sides 13. In this alternative embodiment, the benefits of additional seating of the fastener F within the socket during the driving operation are also experienced. As with the embodiment illustrated above, socket 10 includes a magnet 8 disposed on the base 9 of the aperture 12 to additionally ensure the retention of the fastener F within the socket 10.

The following is a list of suitable parts and materials for the various elements of the preferred embodiment of the present invention.

PARTS LIST

| PART NUMBER | DESCRIPTION |
|---|---|
| F | fastener |
| S | socket |
| 2 | socket housing |
| 4 | socket opening |
| 6 | fastener head side |
| 8 | magnet |
| 9 | base |
| 10 | socket |
| 11 | drive shank |
| 12 | aperture |
| 12b | counter-bore |
| 12c | conical section |
| 13 | aperture sides |
| 14 | fastener head |
| 14s | fastener head side |
| 15 | boss |
| 16 | face |
| 17 | shoulder |
| 18 | flat |
| 20 | conical side |

The foregoing embodiments are presented by way of example only; the scope of the present invention is to be limited only by the following claims.

I claim:

1. A tubular socket tool for driving a threaded fastener having a circumferential shoulder surrounding the head adjacent the threaded portion, comprising;

a driving end portion, having a driving shank for receiving a rotational driving force;

a socket opening end portion for receiving the head of a polygonal headed threaded fastener;

the socket open end portion having an axial polygonal aperture of a cross section complementary to closely receive the head of the fastener and a depth sufficient to at least receive the head of the fastener;

the socket open portion additionally having a circular counter-bore extending into the fastener head receiving aperture of a perimeter and depth to receive the shoulder of the fastener head;

whereby, when a polygonal headed fastener is placed in the polygonal aperture, the head is closely received in the aperture and the shoulder is closely received in the counter-bore thereby receiving enhanced driving support.

2. The socket tool of claim 1 wherein the counter-bore is a conical section extending axially inwardly a depth of at least the depth of the fastener shoulder.

3. The socket tool of claim 2 wherein the socket aperture is hexagonal.

4. The socket tool of claim 1 wherein the counter-bore is a cylindrical section extending axially inwardly a depth of at least the depth of the fastener shoulder.

5. The socket tool of claim 4 wherein the socket aperture is hexagonal.

* * * * *